United States Patent [19]

Schumann et al.

[11] Patent Number: 4,969,927

[45] Date of Patent: Nov. 13, 1990

[54] PROCESS AND DEVICE FOR THE MACHINE-WASHING OF FABRICS WITH A PARTICULATE PRODUCT

[75] Inventors: Karl M. Schumann, Bad Soden, Fed. Rep. of Germany; Brian E. Talkes, Mitford, Great Britain; Colin J. Lowery, Westerhope, Great Britain; James R. Lickiss, South Gosforth, Great Britain; Malcolm Curtis, Meadow Field, Great Britain; Haydn G. W. Dickenson, Kinningworth Village, Great Britain

[73] Assignee: The Procter & Gamble Company, Cincinnati, Ohio

[21] Appl. No.: 353,843

[22] Filed: May 18, 1989

[30] Foreign Application Priority Data

May 18, 1988 [FR] France ..... 88 06660
Jan. 11, 1989 [FR] France ..... 89 00288

[51] Int. Cl.[5] ..... D06F 39/02

[52] U.S. Cl. ..... 8/159; 68/17 R; 68/235 R; 206/0.5; 206/216

[58] Field of Search ..... 8/158, 137, 159; 68/17 R, 235; 206/0.5, 216

[56] References Cited

U.S. PATENT DOCUMENTS

| | | | |
|---|---|---|---|
| 3,048,993 | 8/1962 | Lucas et al. | 68/17 |
| 3,400,808 | 9/1968 | Richter . | |
| 3,754,871 | 8/1971 | Hersel et al. | 206/0.5 X |
| 4,642,258 | 2/1987 | Majewski et al. | 206/0.5 X |
| 4,835,804 | 6/1987 | Arnau-Munoz et al. | 206/0.5 X |

FOREIGN PATENT DOCUMENTS

| | | |
|---|---|---|
| 0290332 | 11/1988 | European Pat. Off. . |
| 870985 | 2/1953 | Fed. Rep. of Germany . |
| 809365 | 3/1937 | France . |
| 2563250 | 10/1985 | France . |

*Primary Examiner*—Frankie L. Stinson
*Attorney, Agent, or Firm*—R. C. Witte; J. V. Gorman

[57] ABSTRACT

A process for the machine-washing of fabrics according to which a dispensing and diffusing device of the reusable type is filled with a particulate product which is active during the washing. This device is placed in the machine together with the fabrics to be washed, and washing is subsequently carried out in the customary way. The device used comprises a flexible bag mounted on a ring made of plastic with helical radial walls providing apertures through the mouth delimited by the ring. A assembly in the form of a cage can be arranged inside the sleeve of the bag in order to maintain the form of the latter during the washing. The product dissolves progressively and little escapes from the device in solid form.

9 Claims, 6 Drawing Sheets

PROCESS AND DEVICE FOR THE MACHINE-WASHING OF FABRICS WITH A PARTICULATE PRODUCT

TECHNICAL FIELD

The present invention relates to the sector of the machine-washing of fabrics. Its subject is a new washing process making it possible to utilize as efficiently as possible the products available on the market at the present time in solid form, especially in powder form, which are employed in a washing operation, for example detergents or other special additives having an activity during the washing. The invention also relates to a device for putting such a process into practice.

BACKGROUND OF THE INVENTION

Washing is increasingly carried out in machines by means of products in the form of powder, granules or in other solid particulate forms. The machines for washing fabrics (hereinafter sometimes referred to as linen) are mainly drum-type machines, but so-called agitator/pulsator machines are also found. Whatever the type of machine employed, the specialists know that the conditions of use of such products are far from ideal. In fact, there is a real problem involved in ensuring a uniform distribution of the particulate product and its dissolving in the washing medium contained in the machine tub. The technical problems regarding powder detergents will be illustrated more particularly hereafter, but it is clear that similar problems arise with detergents taking another form and with any additives having an activity during the washing.

Most of the time, there are machine compartments or containers for receiving the appropriate quantity of powder detergent before the actual washing operation. The powdery active product is thought to be carried into the machine tub by the water as the operation proceeds. However, it has been found that the powder detergent is not carried along completely by the water at all, and therefore more or less large residual quantities remain in the dispensing container. Thus, the intended quantity of powder detergent is not actually used up, and this is detrimental to the efficiency of the washing operation. Furthermore, the containers of the washing machines are always soiled with residues obtained from previous operations. This difficulty is well known and is the subject of many complaints by users.

Another technical problem presented by the use of powder detergents is that the active product does not dissolve completely within the tub, so that the powder which is carried along by the water and which has been unable to dissolve in it in the appropriate way falls directly to the bottom of the tub. Depending on the type of machine, the loss of product in the drainage system can reach 20% of the quantity initially placed in the containers. The undissolved powder is discharged directly into the drainage system of the machine, and in the end this prompts the user to increase the dosage of powder in order to ensure the best possible washing.

To avoid the above-mentioned disadvantages and prevent the losses of detergent in the dispensing containers, some users resort to a rough-and-ready expedient which involves placing the detergent powder directly on the drum of the washing machine, before starting the washing operation. Of course, this measure can be adopted only on a top-opening drum machine, and it too is not without its disadvantages. In fact, although the losses in the dispensing containers may be considered to be eliminated, the same is not true of the losses in the drainage system which are then reduced only slightly. At all events, this solution is not satisfactory because the powder passes through the holes in the drum and comes in direct contact with the fabrics. During the rotation of the drum in the water, the dissolving of the particles of detergent powder which have thus come in contact with the fabrics exerts in adverse influence on this. The detergent particles often have a coloration, and therefore the colored granules of detergent dissolve, thereby releasing the colorant into the fabric itself, and can thus cause stains on this. In the same way, if the detergent composition contains peroxygenated compounds, as is desirable to achieve a high washing performance, the corresponding granules, for example the perborate granules, decompose in contact with the fabric and can discolor articles of delicate color.

There is therefore an undoubted technical problem associated with the fact that the detergents or washing agents present in particulate form do not satisfy the best possible conditions for dissolving in the water during the washing.

To solve such a problem, the present invention employs the concept of a process in which a device is first filled with detergent and is subsequently placed in the machine together with the fabrics to be washed. This concept has been applied to liquid detergents, and a reference which illustrates such a state of the art is French Patent No. 2,563,250 issued Dec. 15, 1986 and entitled: "Process for the machine-washing of linen with a liquid detergent and device for carrying it out". In this case, the detergent contained in the device diffuses progressively into the washing medium and into the fabrics located in the machine. In one embodiment, the device has a filling orifice and vents for the progressive release of the liquid into the linen during the washing.

However, when such a concept is to be applied purely and simply to particulate detergents, in many cases practical difficulties arise. This is because the dissolving of the solid particles of detergent in the washing water is not ensured satisfactorily if such a detergent is placed in a device having orifices, such a device subsequently being introduced into the machine in the middle of the fabrics. In fact, it was found that the presence of orifices on the device, capable of ensuring the diffusion of the detergent, did not allow the powder to dissolve properly. Nor is an increase in the number and/or size of the orifices a satisfactory solution, because it comes up against the same disadvantages as those mentioned at the start of this description, namely the losses of powder in the drainage system and/or contact with the linen when the particles are still solid. It was also found that a reduction in the number and/or dimensions of the orifices results in a progressive locking of the orifices by the wet powder, so that the detergent can no longer escape from the device in order to perform the washing function. The entire discussions set out above therefore shows that, as a general rule, powder detergents cannot be used in the best possible way in dispensing and diffusing devices, even though these prove entirely suitable for liquid detergents.

European Patent Application No. 88/401065.3 published under No. 0290332 on Nov. 9, 1988 proposed using a dispensing and diffusing device containing a detergent in solid form and ensuring that the powder is predissolved before its progressive release into the linen. In one embodiment, such a device comprises a body capable of being filled with the desired quantity of detergent and removable means for closing off this body, the body or the removable means having holes or vents for the release of the detergent. The device is characterized in that it possesses means separating the part of the device having the holes or vents from the part containing the particulate detergent and designed to allow the washing water to pass through freely and practically prevent the massive and uncontrolled escape of the particulate detergent. A structure which has the general shape of a body of revolution closable by means of a removable cap which has holes allowing both the inflow of the water into the device and also the diffusion of the detergent. It is characterized more particularly in that it possesses at least one plate mounted inside the device in order to separate the cap and the part of the body containing the particulate detergent. The plate has at least one orifice, the area of which is less than that of the holes or vents of the cap. Thus, the perforated plate makes it possible to retain the particulate detergent in the body of the device, whilst at the same time allowing the washing water to dissolve this detergent before it is released into the washing machine.

It is an object of the present invention to solve the technical problems mentioned in the above referenced European Patent Application whilst preserving the concept of the progressive diffusion and progressive dispersal of an active product available at the outset in particulate form into the washing medium and into the fabrics ensuring that this product is predissolved before its diffusion. In fact, it is desirable to perfect a dispensing and diffusing device which, whilst preserving a simple structure, makes further improvements to the devices already provided for this purpose with regard to particulate detergents and especially makes it possible to:

- reduce the amount of plastic used in the device, this meeting the increasingly important requirements for the protection of the environment, the regulations in this respect being aimed at preventing the disposal of plastic articles which are not normally destroyed in natural surroundings,
- obtain a minimum overall size, in order to satisfy the requirements as regards packaging, transport and storage, and
- eliminate the noise caused by the dispensing and diffusing devices in the washing machines, in order to satisfy the expectations of some users.

The present invention provides a solution to these technical problems and to others, as will emerge from the following description, whilst at the same time preserving intact the benefits of the dispensing and diffusing devices already provided for particulate detergents, especially those which are the subject of the above mentioned European Patent Application.

SUMMARY OF THE INVENTION

The invention relates to a process for the machine-washing of fabrics, according to which a dispensing and diffusing device of the reusable type is filled with particulate product which is active during the washing. This device is placed in the machine together with the fabrics to be washed, and washing is subsequently carried out in a customary way. The device essentially comprises a flexible bag-shaped sleeve extending round at least one orifice which allows the bag to be filled with the desired quantity of product corresponding substantially to one washing operation and which remains at least partially open during the washing. The aqueous washing medium penetrates into the bag at least via the orifice for the purpose of the progressive dissolving of the particulate product, the latter thus being released progressively during the washing predominantly in the form of an aqueous solution passing at least through the orifice of the bag.

According to the invention, the bag is made of a material capable of retaining the particulate product, without letting it pass through in solid form, and of withstanding the temperatures of the machine-washing and machine-drying of linen.

According to a preferred embodiment of the invention, the component material of the bag is designed to allow the aqueous washing medium to penetrate through the bag towards the particulate product contained there and an active aqueous solution, obtained as a result of the progressive dissolving of the particulate product and passing through the bag, to diffuse from the inside of the latter towards the outside. In this embodiment, the bag is permeable to water. The penetration of the aqueous washing medium takes place both via the mouth orifice of the bag and through the latter, and the diffusion or release of the active product solution likewise takes place via the mouth of the bag and through the latter.

The process of the invention can be used not only for detergents in solid form, but also for any particulate product having an activity during the washing, for example selected from bleaching agents, such as agents releasing chlorine or active oxygen (peroxygenated compounds), bleaching catalysts, bleaching activators, bactericides, foam regulators, brightening agents, dirt anti-redeposition agents, enzymes, softeners, agents exerting an action to remove grease stains or constituents not exerting a direct action on the dirt, but capable of taking action in a process for the machine-washing of fabrics, for example agents providing protection for the internal members and parts of the washing machine.

In the present description, the expression "particulate product" embraces all the forms of presentation of such solid products, such as powders, granules, flakes, pellets and other similar physical structures capable of being dissolved in water under the normal washing conditions. The process according to the invention is especially useful with detergents present in the form of so-called high-density particles, which have already been developed at the present time in some countries. They afford advantages in terms of packaging, transport and storage over similar traditional products because of the reduction in bulk which they make it possible to achieve. However, because of their chemical composition and their physical structural characteristics, such detergents with high-density particles tend to cause losses in the dispensing container and in the drainage circuits which are even greater than traditional powder detergents. In some cases, the dissolving capacity of these new detergents is lower than that of the known products. The individual packaging used for these detergents in the form of high-density particles often has smaller volume, and this means that there is less space available for the insertion of dispensing and diffusing devices. These new technical problems associated with the incidence of detergents in the form of high-density particles often has a smaller volume, and this means that there is less space available for the insertion of dispensing and diffusing devices. These new technical problems associated with the incidence of detergents in the form of high-density particles are also solved by the process of the present invention, which makes use of a dispensing and diffusing device essentially comprising a bag made of flexible material.

The device used according to the invention differs in many respects from some known means of the prior art which consisted of sachets or pouches capable of containing a detergent or an additive useful in the washing, which can be present such products in particulate form in the sachet. First of all, the pouches or sachets of the prior art contain a predosed quantity of product and cannot be reused. Their design does not make it possible to release the product progressively, the latter being dispensed completely either immediately at the start of the washing cycle or during the cycle. The device of the present invention does not have the disadvantages of the sachets or pouches of the prior art. According to the invention, the device is of the reusable type, and the quantity of product (detergent or any additive) can be dispensed in a desired dose because of the presence of the mouth which serves for filling with the product. Moreover, an average person skilled in the art knows that, to allow the active product to diffuse, the sachets or pouches of the prior art must have a wall soluble in water or in the washing medium or, if this wall is not soluble in water, there must be joints or connections capable of dissolving in order to release the products. In the first case, namely that of water-soluble walls, there is no problem where the washing machine is concerned, but there are practical difficulties in the storage and marketing of the sachets or pouches because of their sensitivity to moisture. This solution is therefore technically unacceptable, unless much more costly measures regarding the design of the wall are adopted. In contrast, with insoluble pouches or sachets, the body of these is released at the same time as the active product, thus giving rise to serious disadvantages for the members of the washing machine, in this case the pouches or sachets emptied of their content causing sundry damage, such as the clogging of the drainage circuits. Such practical difficulties are well known to an average person skilled in the art and therefore need not be explained in any more detail. Contrary to the means of the prior art, the device according to the present invention can be recovered at the end of the washing, without risk for the machine, this being plainly essential for the practical needs of the users.

The process according to the invention can be carried out with a wide variety of devices having a flexible bag.

The component material of the flexible bag can be of any type, provided that it has sufficient resistance to water and to the washing medium at the temperatures which are used during the washing and during the drying and which can thus attain approximately 150° C. It can therefore be a woven or nonwoven material produced from natural or synthetic fibers or a mixture of these. Purely as an illustration, it is possible to use a bag formed from a flexible sleeve made of pure cotton either in the form of a fabric having a mesh aperture of less than approximately 0.5 mm or in the form of a nonwoven article which apertures ranging especially from 0.5 to 0.8 mm. The bag can also be produced from extruded or coextruded films having perforations. The dimensions of these can vary within wide limits, depending on the type and granulometry of the particulate product. As an illustration, films with perforations of approximately 380 microns can be used. However, the material for the bag is not necessarily a textile material. The sleeve can also be produced from a plastic netting or from a sheet of paper or other porous water-resistant cellulose material. If the material provided for the flexible bag does not itself have sufficient resistance to water, it can be equipped with a covering making it water-resistant. For example, where porous paper is concerned, the covering can consist of a latex-based binder associated with a water-repellant substance.

The invention has hitherto been described with regard to the preferred embodiments which involve using a flexible bag, the sleeve or wall of which has pores or apertures of varied forms and dimensions, either in an orderly arrangement where a fabric is concerned or random where nonwoven materials are concerned. However, for the requirements of the invention, it is also possible to use a flexible bag, the sleeve of which is completely impermeable to water and to the washing medium, in which case the transfers of fluid in the direction of the interior of the bag and towards the outside of the latter take place solely through the mouth of the bag. In fact, such embodiments are possible if measures are taken to arrange in the mouth means which make it possible to ensure the predissolving of the particulate products, as will be described later.

The external form of the bag can likewise be highly variable, and according to an expedient characteristic of the invention it is possible to match this form to the type of particulate product used and to the conditions under which this product is to be released, as will be shown in examples given later. As an illustration, the bag can be a substantially cylindrical sleeve extending in the prolongation of the mouth, the diameter of the sleeve then being substantially equal to that of the mouth. However, it is also possible to use sleeves which taper from the mouth or, on the contrary, which widen from this. A sleeve of tapered form ensures a relatively quicker release of the particulate product, whereas a widened sleeve allows a relatively slower release. Likewise, because the device according to the invention is of the reusable type and the user can dispense the quantity of particulate product in a desired dose, the flexible bag can have various markings corresponding to filling levels and consequently to variable quantities of particulate products.

It was mentioned above that the device according to the invention had at least one mouth allowing both the filling of the bag with the active product and its release in predissolved form into the washing medium and into the linen located in the machine. In the simplest embodiment, which is preferred, the device has a single mouth or orifice which can be of any cross-section: circular, oval, square, rectangular and the like. Good practical results have been obtained with mouths of circular cross-section.

It is expedient if the mouth of the bag is delimited by a means serving as a support for the sleeve of the bag. This can be achieved in a simple way by means of a ring, the cross-section of which is that provided for the mouth. This ring can be made of a material of entirely variable hardness, the only condition being that the mouth is kept open during the washing. The component material of the ring can be a plastic, metallic, wood, cardboard made water-resistant and any other similar material. Good practical results are obtained with plastics which are easily worked in order to produce the desired shapes of the ring. As an example, polyethylene and polypropylene are perfectly suitable.

It was said above that the mouth of the bag had to be kept at least partially open during the washing, in order to allow the progressive release of an aqueous solution of active product. It is therefore possible, as a borderline case, to use flexible-bag devices in which the mouth is completely free, but it is generally preferable to use devices in which the mouth additionally has means making it possible to mask it, with the exception of some predetermined means associated with the ring delimiting the mouth make it possible at the same time:

- to ensure the filling of the bag with the particulate product,
- to prevent the particulate product from escaping from the bag in large quantities in particulate form during the washing,
- to make the interior of the bag accessible to the washing medium, in order to ensure the predissolving of the particulate product, the release of the latter thus taking place essentially in the form of a solution passing, at least partially, through the mouth from the inside of the bag towards the outside.

It goes without saying that the means intended for masking the mouth will have to be matched to the form and type of the ring delimiting the latter. Purely illustrative examples will be given later. Good practical results have been obtained with a ring possessing radial walls terminating in a solid central zone, in such a way that apertures are thus provided between each of the said radial walls. The walls in question can be straight or, on the contrary, can have a particular profile, for example in helical form. However, many other alternative versions are possible: for example, within the ring delimiting the mouth there can be walls concentric relative to this ring and extending towards the inside of the latter, with radial walls arranged between the said intermediate partitions and the outer ring.

By means of routine tests, an average person skilled in the art can select the forms and dimensions of the apertures made in the mouth in order to obtain the best results according to the type of active product to be used during the washing. Illustrative examples will be given later.

According to an additional embodiment, the form of the ring surrounding the flexible bag can be chosen so as to make it easier to extract the particulate product from a pack of larger size, for example a barrel or cask. For this purpose, the ring can be arranged in such a way that its outer edge functions as an extracting scoop. The ring, to make it easier to grasp it, can also have surface irregularities, in relief, or recessed, making it possible to hold it firmly with the fingers. However, it is also possible to fasten to the ring an element allowing it to be grasped. Such an element can be fitted permanently, in which case it is preferably of small size, or alternatively this element consists of a handle of larger size which can be fastened removably to the body of the ring by any suitable means.

According to an expedient characteristic of the present invention, the choice of a particular type of dispensing and diffusing device with a flexible bag can be matched to the active product to be used during the washing. Thus, devices, the mouth of which remains completely open during the washing and which have no masking means, can be used to contain detergents or additives having constituents dissolving only slowly in water. An example of a detergent composition possessing such characteristics is as follows:

| | |
|---|---|
| Alkyl sulphates | 7–10% |
| Fatty acid | 1–3% |
| Aluminium and sodium silicates | 15–25% |
| Water-soluble polymers | 1–3% |
| Sodium silicate | 3–8% |
| Sodium sulphate | 10–40% |
| Sodium carbonate | 5–10% |
| Alkalase (enzyme) | 0–2% |

In the above composition and in the other examples which follow, all the parts are expressed by weight, unless indicated otherwise. Another example of a detergent composition which can be employed for delicate washing and which can be used with an open-mouth dispensing and diffusing device is as follows:

| | |
|---|---|
| Alkyl sulphates | 10–20% |
| Fatty acid | 1–3% |
| Aluminium and sodium silicates | 20–30% |
| Sodium silicate | 1–5% |
| Sodium sulphate | 20–40% |
| Sodium carbonate | 0–5% |

Additives which can also be used in such a dispensing and diffusing device are, for example, products exerting a softening action on the washing water.

A dispensing and diffusing device having a mouth with masking means can be used with detergents for coarse washes, in which it is expedient to avoid direct contact between the linen and some of their constituents. The following composition may be mentioned as an example of a detergent composition for coarse washes which comes within this category:

| | |
|---|---|
| Alkyl sulphates | 7–10% |
| Fatty acid | 1–3% |
| Aluminium and sodium silicates | 15–25% |
| Water-soluble polymers | 1–3% |
| Sodium perborate | 10–25% |
| Sodium silicate | 3–8% |
| Sodium sulphate | 10–40% |
| Sodium carbonate | 5–10% |
| Alkalase | 0–2% |

Additionally, the above composition can contain up to 5% of a bleaching activator, such as tetraacetylethylene diamine or iso-nonanoyl oxybenzene sulphonate.

Some particulate products can have difficulties in dissolving in the aqueous medium, after being introduced into the flexible bag. Thus, powder residues, wet but undissolved, have sometimes been seen remaining inside the bag at the end of the washing operation.

Another subject of the present invention is also a process of the general type described above, ensuring a complete dissolving of the particulate product during the washing cycle.

Yet another subject of the invention is devices of a structure designed to preserve the lifetime of the flexible sleeve forming the bag.

According to another embodiment of the present invention, the device used possesses means extending inside the bag from the mouth of the latter, the said means ensuring that the general form of the bag is maintained at least partially during the washing.

A device for putting this embodiment into practice is therefore characterized by the presence of the abovementioned maintaining means which are placed inside the sleeve of the bag.

It was found that the general form of the sleeve of the bag was thus preserved substantially during the entire washing operation, the maintaining means particularly preventing the flexible walls of the sleeve from coming nearer to one another. This eliminates the disadvantage, found in some cases, that a small portion of particulate product is as it were trapped when the walls of the bag are brought nearer to one another until they virtually come in contact, this quantity of particulate product even possible being compressed between the walls of the bag, thus making it less easy for the aqueous medium to dissolve it. As a result of the present invention, the form of the bag is preserved substantially intact, so that the particulate product dissolves completely and normally during the washing, so as to be released progressively through the mouth of the bag, and, if the component material of the bag is permeable to water, through the sleeve of the bag.

In the first embodiment, the maintaining means consist of a rod which plunges into the bag and of which one end is fastened in the region of the mouth and the other end is free.

The length of such a rod is variable, and this can extend into the bag at various levels from the mouth as far as the bottom of the latter.

It is preferable if the cross-section of the rod is markedly less than the cross-section of the bag, so that the sleeve of the latter can perform its function, without being impeded by the presence of the rod inside the bag. It is also expedient if the free end of the rod has a part widened or flared towards the bottom of the bag. This widened part can have the form of a disc produced in one piece with the rod or fixed to the latter by any means. This widened part can be solid or perforated, in the latter case so as to allow free access to the aqueous medium more easily as far as the bottom of the bag.

It was found that, to ensure that the form of the bag was maintained effectively, the length of the rod was appropriately such that the widened part was in the vicinity of the bottom of the bag.

In other embodiments according to the invention, the maintaining means consist of a cage projecting into the bag.

The said cage can comprise a first end part, interacting with the mouth, in order to be fastened to the latter, and a second end part which is free and which extends inside the bag. This first end part can be shaped in the form of a rod, in order to be fastened in the region of the mouth of the bag, together with the ring delimiting this mouth or, preferably, together with the masking means of this mouth, if they are present.

The said cage also possesses a certain number of members having the form of bars which generally extend in the direction of the longitudinal axis of the bag. It is advantageous if these bars are held at each end by means of a member which is annular or of any other cross-section generally corresponding to those of the mouth and of the sleeve of the bag.

According to yet another embodiment which has given the best results at the present time, the maintaining means consist of an assembly, the longitudinal axis of which corresponds generally to that of the bag, the said assembly comprising, at one end, a first member interacting with the means delimiting the mouth of the bag or with the means for masking this, if they are present, and, at the other end, a second member located inside the bag, the said members serving as a support for bars which generally extend longitudinally inside the bag.

It was found that the best washing results, especially in terms of the dissolving of the particulate product, were obtained with an assembly of the type just mentioned, in which the bars extend in the vicinity of the sleeve forming the bag. It is also preferable if the assembly is placed on the mouth, the second member being located inside the bag in the vicinity of the bottom of the latter.

The embodiments just mentioned in order to illustrate the maintaining means inside the sleeve of the bag can make use of all the information and embodiments described above, for example with regard to the type of particulate product, the general structure of the dispensing and diffusing device and the component materials of the latter. It will also be seen that the results of the invention can be obtained with highly varied embodiments of the means for maintaining the form of the bag during the washing operation. The following description gives illustrative examples.

In practice, the volume of the flexible bag must be selected according to the dose of active product to be dispensed during the washing. Where a detergent composition is concerned, suitable volume values for the flexible bag are approximately 250 ml to 400 ml, thus making is possible to introduce into it quantities by weight of particulate detergent of the order of 150 to 250 g per wash.

It is also appropriate to note that the process according to the invention, using a dispensing and diffusing device with a flexible bag, makes it possible to employ detergent compositions which at the present time cannot have any practical use because they cannot be suitably dispensed from the container or compartment equipping the washing machine. This is already true of some high-density detergent compositions already mentioned above. However, the same remark can be made regarding other detergent compositions having only moderate solubility in water. The process according to the invention therefore makes it possible to use detergent compositions affording better washing performances, for example by reducing or even eliminating the fillers of the sodium sulphate type, whilst at the same time increasing the proportions of surface-active agent, for example anionic and non-ionic. The invention can likewise be put into practice with particulate products of highly variable granulometry, because an average person skilled in the art has numerous parameters in the dispensing and diffusing device in order to select the device which is the most appropriate for the type of active product: the component material of the flexible bag and the form of the latter the mouth with or without a masking means, the forms and dimensions of the mouth and of the apertures in it, if a masking means is present, maintaining means inside the sleeve of the bag, and other similar parameters.

When reference is made in this description to a mouth orifice or an aperture, these expressions are intended to denote passages if any form, through which products present in particulate form or liquid, pastry or suchlike products can pass.

The foregoing description and the following actual examples illustrate clearly the technical problems solved by the invention and the advantages which it affords.

The process according to the invention makes it possible to dispense detergents, additives or other active washing products available in particulate form into the middle of the linen located in the machine, thereby supplying higher concentrations of detergent solution in contact with the linen and thus increasing the washing performances and quality.

The invention virtually completely eliminates the losses of active product, especially of detergent, which occur when the dispensing compartment of the washing machine is used, the losses in the drainage circuit of the machine likewise being eliminated.

The quantity of plastic used in the dispensing and diffusing device is very small, because it is restricted to that of the ring delimiting the mouth and carrying the flexible bag. In some cases, it is not even necessary to use plastic to produce such a ring. The invention thus provides better protection of the environment, since the component materials of the device are essentially degraded in the natural surroundings.

Practical tests also demonstrated that the use of the dispensing and diffusing device with a flexible bag did not cause any noise inside the machine during the washing operation. The device does not cause any damage to the fabrics because of its low weight.

The very small overall size of the dispensing and diffusing device with a flexible bag makes it possible to combine it in the most efficient possible way with the packaging of the particulate products, such as the detergents and other additives useful in the washing. Individual packs containing larger quantities of particulate product and/or packs themselves of reduced overall size can thus be used. The device in questions in very easy to handle and store because it occupies only a greatly reduced space.

Contrary to the pouches or sachets containing a predetermined dose of active product, the invention makes it possible to use any desired quantity of product, depending on its type. Even the dispensing and diffusing device most suitable for the characteristics of the product is therefore chosen, a particular type of device thus being assigned to an individual product pack.

The process according to the invention is also very easy to carry out, because the dispensing and diffusing device can serve directly for extracting the active particulate product. Once the washing operation has ended, the device is easily recovered from the machine and can subsequently be reused. Even if the user forgets the device in the machine or in the dryer, this does not have any disadvantage either for the machine or for the fabrics in the subsequent washing operation.

An average person skilled in the art will appreciate that the present invention therefore offers great flexibility in solving the various technical problems of the machine-washing of linen with particulate active products.

BRIEF DESCRIPTION OF THE DRAWINGS

The invention will be further illustrated, without being limited in any way, by the following description, with reference to the accompanying drawings in which.

DESCRIPTION OF THE PREFERRED EMBODIMENTS

Figure 1:
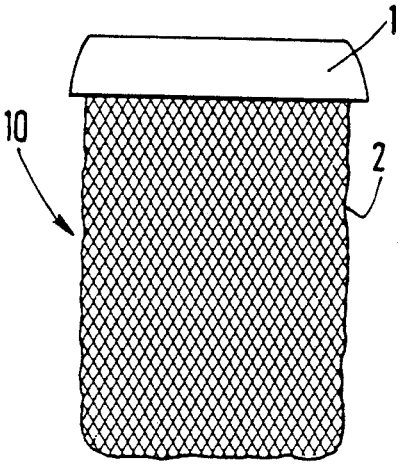
FIG. 1 shows a diagrammatic front elevational view of a dispensing and diffusing device which can be used in the process of the invention.

The dispensing and diffusing device, designated by the general reference 10 in FIG. 1, comprises essentially a ring 1 and a bag 2 made of flexible material, for example cotton fabric. The size of the mesh apertures of the fabric 2 must be such that it can prevent the free passage of a particulate product, especially a detergent, placed inside the bag, even where the finest particles are concerned. In the example illustrated in FIG. 1, the bag 2 has an approximately cylindrical general form, but alternative versions are shown in FIG. 2 and 3, which illustrate different forms.

Figure 2:
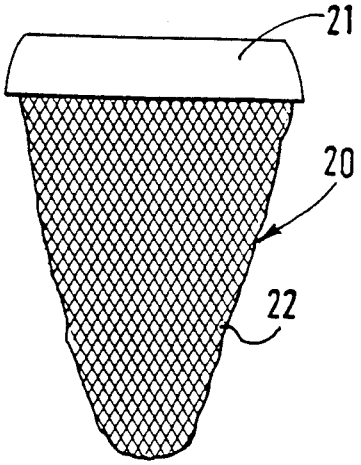
FIG. 2 is a view similar to that of FIG. 1, showing an alternative version.
Figure 3:
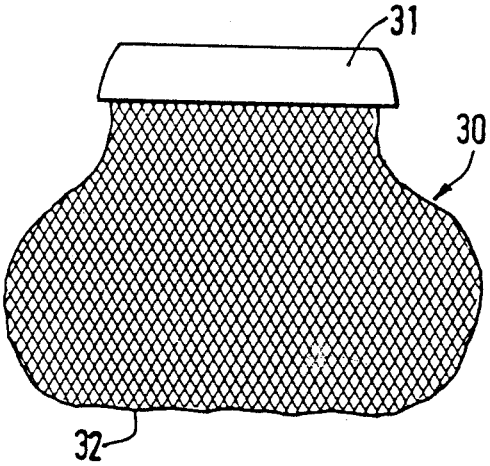
FIG. 3 is a view similar to those of FIGS. 1 and 2, showing another alternative version.

In FIG. 2, the device 20 comprises a ring 21 carrying a flexible bag 22 which tapers towards the tip. The device 30 of FIG. 3 comprises a ring 31 and a flexible bag 32 which widens from the mouth delimited by the ring 31. The form of the bags makes it possible to vary the characteristics of retention of the particulate product inside the bags and consequently the capacity of the particulate product in predissolved form to diffuse into the washing medium and into the linen. Thus, the bag 22 of FIG. 2 provides quicker diffusion characteristics than the bag 32 of FIG. 3, the structure of the ring 31 and of the corresponding mouth being the same.

Figure 4:
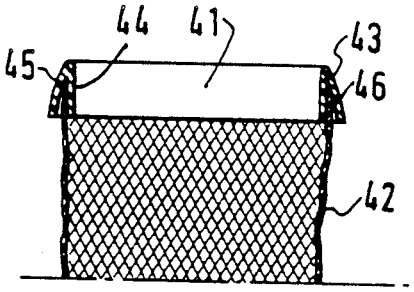
FIG. 4 is a fragmentary vertical cross-sectional view illustrating the mounting of the flexible bag on a supporting ring.

FIG. 4 is a sectional view showing diagrammatically the mounting of a flexible bag 42 on a supporting ring 41. In this example, the latter is made of plastic, for example polypropylene. It is formed from an outer wall 43 connected to an inner wall 44, the later being substantially cylindrical. Between these two walls is provided a compartment 45, inside which the end edge 46 of the bag 42 can be inserted. To ensure that the bag 42 is held on the ring 41, any suitable means can be used, for example an adhesive capable of withstanding the temperatures used in washing machines, including those where drying is carried out, in which case the temperatures can attain 150° C.

Figure 5:
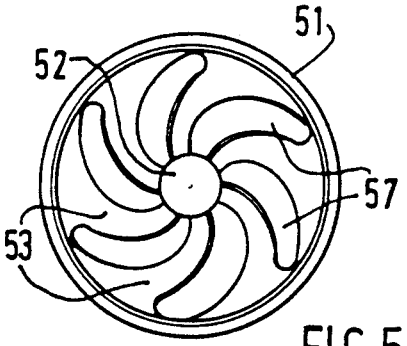
FIG. 5 is a plan view of a ring delimiting the mouth of the bag.
Figure 6:
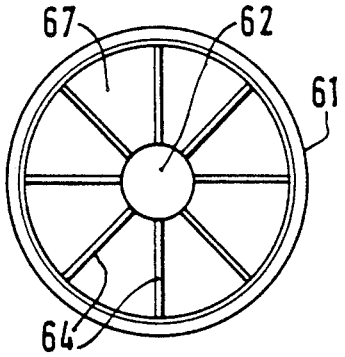
FIG. 6 is a view similar to that of FIG. 5, illustrating an alternative version.
Figure 7:
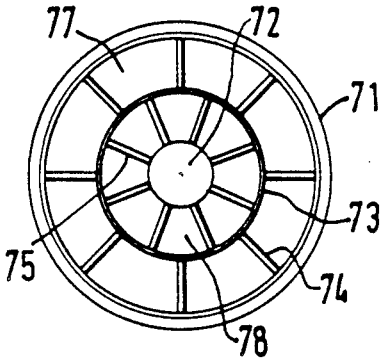
FIG. 7 is a view similar to those of FIGS. 5 and 6, illustrating another alternative version.

FIG. 5 shows a diagrammatic plan view of the structure of a ring which has given good practical results when the process of the invention has been put into effect. It essentially comprises a peripheral wall 51 arranged in the same way as the ring 41 shown in FIG. 4. Mounted at the center of the ring 51 is an insert 52, from which a certain number (in the chosen example, this number is equal to 6) of elements 53 in the form of turbine blades extend. Apertures 57 are provided between the elements 53. A ring of the type shown in FIG. 5 allows the filling of an associated flexible bag, whilst at the same time preventing a massive escape of particulate product via the apertures 57. In fact, during the running of the machine, the device is rolled at the same time as the fabrics, thus benefiting the bringing of the particulate product in contact with the washing medium, the latter penetrating both via the pores of the flexible bag and via the apertures 57. In contrast, because of the presence of the blades 53, the particulate product escapes scarcely at all in undissolved solid form. It goes without saying that the example of FIG. 5 is only illustrative. Many other alternative versions can also be provided. As an indication, FIG. 6 shows a ring comprising a peripheral wall 61, an inner hub 62 and straight radial partitions 64 for providing apertures 67 between them. FIG. 7 shows a ring comprising a peripheral wall 71, an intermediate wall 73 of concentric form and an inner hub 72. Between the walls 71 and 73 there are radial partitions 74 forming apertures 77 between them. Likewise, between the wall 73 and the inner hub 72 there are radial walls 75 providing apertures 78 between them. Results equivalent to those with the device of FIG. 5 can be obtained by means of the devices of FIGS. 6 and 7, if the number and dimension of the apertures thus obtained are selected appropriately.

FIGS. 5 to 7 have been given only as an illustration for an average person skilled in the art. It can also use structures which are the subject of FIGS. 4 to 23 of the aforementioned European Patent Application which are hereby incorporated by reference in this specification.

Figure 8:
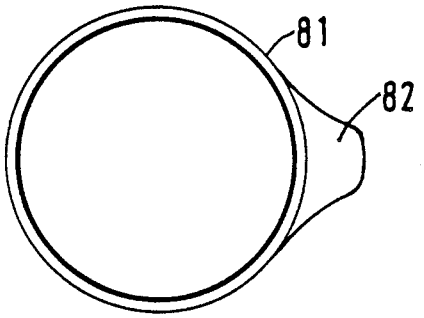
FIG. 8 is a diagrammatic plan view showing a ring with a grasping means.
Figure 9:
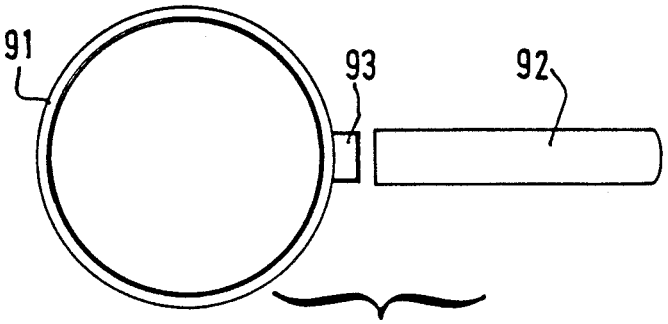
FIG. 9 is a view similar to that of FIG. 8, illustrating an alternative version.

FIGS. 5 to 7 illustrate rings which all have, on the inside, some elements which function as masking means for preventing the particulate product from being released in solid form from inside the bag. However, depending on the type of particulate product to be used, it is perfectly possible to employ rings which leave the mouth of the bag completely free. This type of ring is shown in FIGS. 8 and 9. For the sake of illustration, the ring of FIG. 8 comprises a peripheral wall 81 equipped with a tongue 82 which can serve as a grasping means. The tongue 82 makes it easier to introduce the particulate product when the latter is extracted from a pack in order to dispense it into the bag. FIG. 9 illustrates an alternative version in which the ring 91 can be equipped with a handle 92 presented separately and fastenable removably at 93 by any suitable quick-fastening means, especially by snapping or catching.

Figure 10:
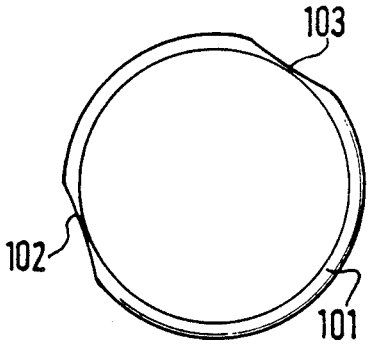
FIG. 10 is a view similar to that of FIG. 8, illustrating an alternative version.

FIG. 10 illustrates another alternative form, according to which the ring 101 has surface irregularities on its outer edge, which are intended to make it easier to hold it with the fingers. In the chosen example, these irregularities are formed by a recess 102, for example for receiving the thumb, and at least one other recess 103 for receiving the forefinger of the same hand. The user can thus take hold of the ring 101 very simply, in order to fill the bag associated with it.

The dispensing and diffusing devices used in the process according to the invention have been shown in FIGS. 4 to 10 with rings delimiting a circular mouth. It has already been said that this form is in no ways obligatory and that oval or suchlike contours can also be used. For washing requirements, it is preferable to have devices without any sharp edge, to avoid causing damage to the linen. Consequently, it is generally preferable to have round or oval structures, rather than structures of square or rectangular cross-section, even if the edges are rounded. At all events, an average person skilled in the art can adopt any form or structure, above all if the ring is made of plastic, because it is easy to produce by the known molding techniques, for example by injection-molding. However, as already mentioned above, it is not essential that the ring be made of plastic, other materials also being suitable.

FIGS. 11 to 18 illustrate embodiments of the device according to the invention with maintaining means arranged inside the sleeve of the bag.

Figures 11, 12:
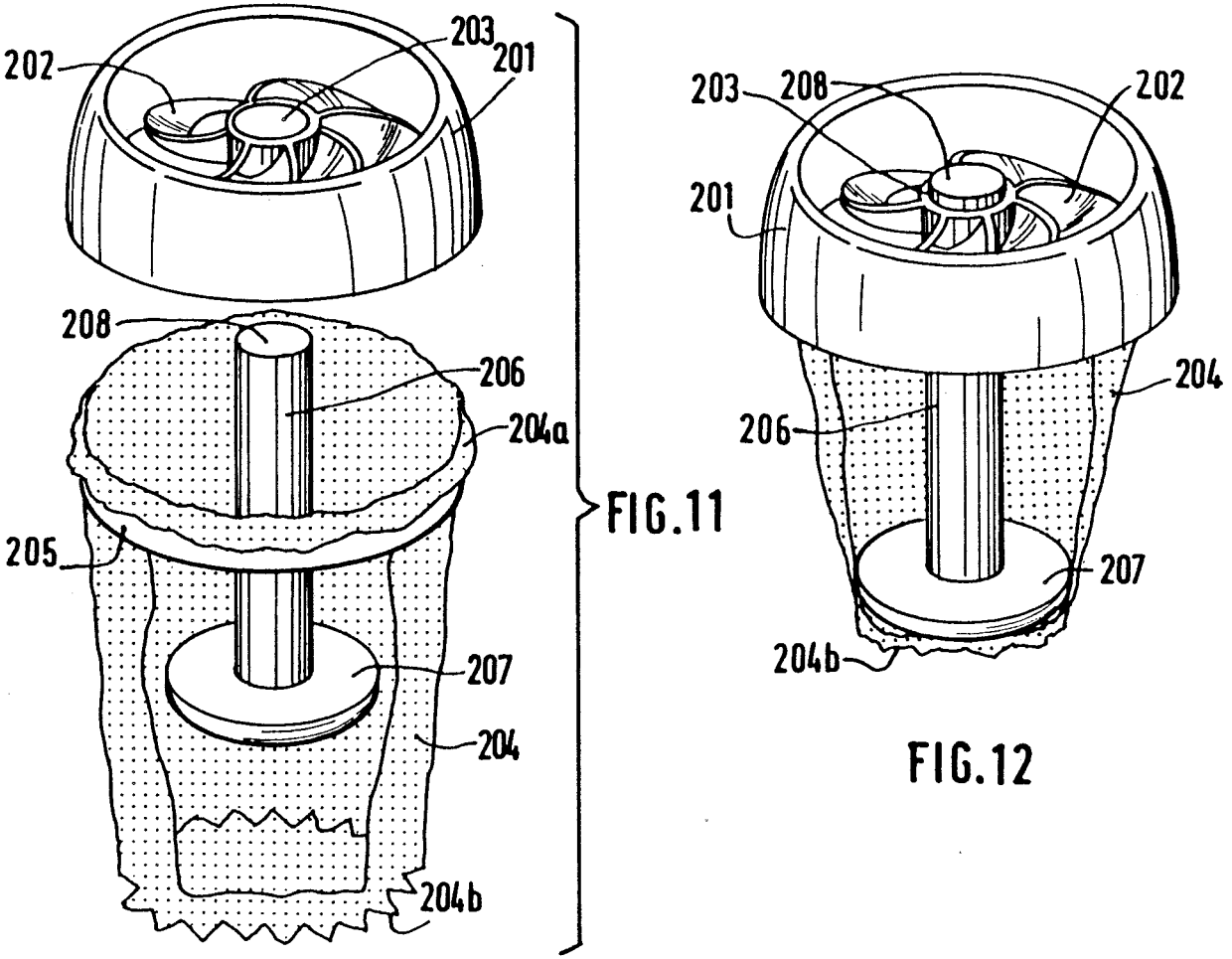
FIG. 11 is an exploded perspective view partially cut away showing the various components of another embodiment of the device according to the invention and the method of assembling the said components.
FIG. 12 is a partially cut away perspective view of the device of FIG. 11, in the state in which it is used.

The device shown in an exploded perspective view in FIG. 11 comprises a part 201 having the general form of a ring delimiting the mouth of the device. In the example illustrated, this mouth has masking means 202 consisting of a certain number of helical webs which start from a hollow central shaft 203 and which terminate on the periphery of the ring 201. This type of device is easy to obtain by the molding of plastic, for example polyethylene or polypropylene. The central part 203 is hollow, thus making the device lighter and also making it possible to carry out the assembly according to the invention, as will be described later.

Furthermore, the device possesses a bag 204, for example in the form of a nonwoven, permeable to an aqueous medium. This bag has an end **204*a* and a bottom 204*b*. The end 204*a* is wound round and fastened to a collar 205 which can be secured in the ring 201** by a matching of forms; this fastening can take place simply by insertion or by any other means, for example screwing or quick fastening of the bead/groove type (snapping). All these methods of assembly are familiar to an average person skilled in the art and are easy to carry out with plastic components.

The device of FIG. 11 also possesses means which, in the example illustrated, consist of a rod 206 terminating at its distal end in a flared or radically enlarged or widened part 207. The rod 206, at its proximal end 208, is driven into the central part 203 of the ring 201.

FIG. 12 shows the device of FIG. 11, once it has been assembled. It can be seen that the maintaining means in the form of the rod 206 extend from the center 203 of the ring 201 to a depth within the bag 204 near the bottom **204*b* of the latter. In this example, the part 207 is solid and the rod 206** extends over virtually the entire length of the bag.

Figure 13:
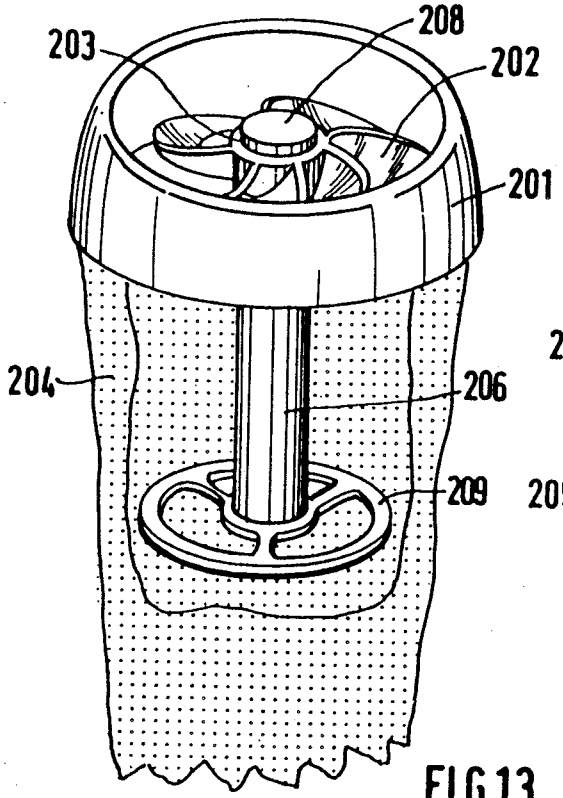
FIG. 13 is a view similar to that of FIG. 12, illustrating an alternative version.

However, it is possible for the device of FIGS. 11 and 12 to have numerous alternative versions which all come within the scope of the invention. The length of the rod 206 can be variable. For example, as shown in FIG. 13, where the same components bear the same reference numerals, the rod 206 does not go as far as the bottom of the bag 204. The cross-section of the flared part 207 can also be of variable size. Likewise, FIGS. 11 and 12 show a solid part 207, but, as illustrated in a top view in FIG. 14, the maintaining means can consist of a rod 206 having a perforated disc 209 at its end extending into the bag; in this example, it can be seen the disc 209 has three orifices **209*b* retained by means of a hoop 209*a*. It is clear that a rod of the type shown in FIG. 14 can also be used in a device according to FIGS. 11 and 12**.

For the purpose of use, the desired quantity of particulate product performing a function during the washing, more especially a detergent, is introduced into one of the devices illustrated in FIGS. 11 to 14. Any one of the particulate products already described above can be used. Tests were conducted with detergent compositions, examples of which will be given later. The volume of the bag 204 must correspond to the quantity of detergent useful for a wash, for example the bag is designed to contain a quantity of the order of 250 g of powder. With a device of the type illustrated in FIGS. 11 to 14, the quantity of undissolved powder at the end of the wash is greatly reduced in comparison with a device not containing any means of maintaining the bag located inside the latter. The tests conducted showed that the devices of the type described with reference to FIG. 12 (rod extending as far as the bottom of the bag) give rather better results than those in which the rod does not go as far as the bottom of the bag.

Figure 16:
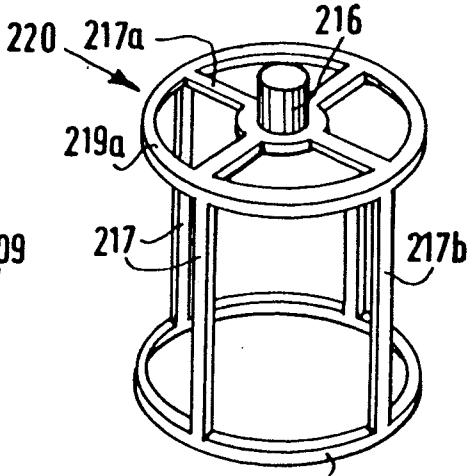
FIG. 16 is a detailed perspective view showing an alternative version of the maintaining means used in the device of FIG. 15.
Figure 14:
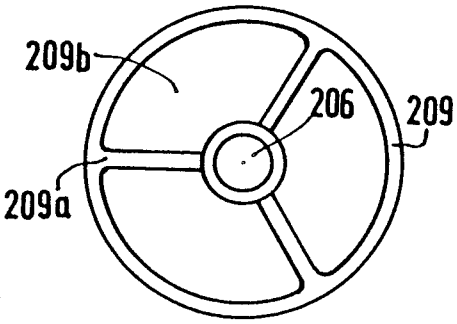
FIG. 14 is a top view showing a detail of a member of the device of FIG. 13.
Figure 15:
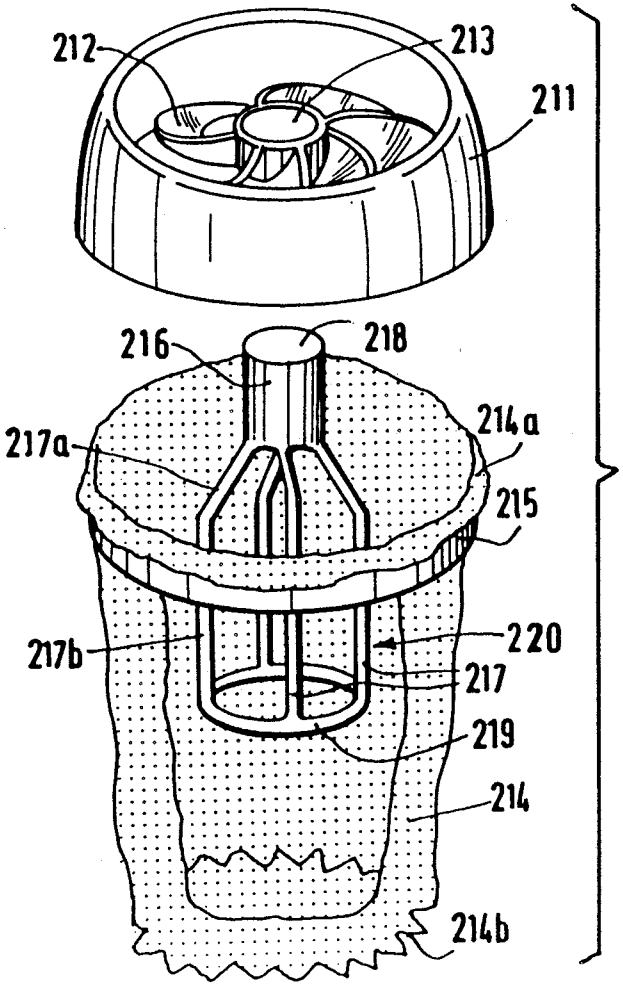
FIG. 15 is an exploded, partially cut away perspective view of another embodiment of the device of the invention.

FIGS. 15 and 16 illustrate other embodiments in which the maintaining means are designed in the form of a cage.

FIG. 15 shows an exploded view of he various components of the device. As in FIG. 11, the ring 211 equipped with its helical masking means 212, with its central aperture 213, can be seen. The bag 214 is fastened at its end **214*a* to a collar 215. The latter interacts with the ring 211 by a matching of forms. The maintaining means designated by the general reference 220, comprise a first end in the form of a cylindrical rod 216 terminating in a part 218 capable of being introduced into the central aperture 213 of the ring 211. At the other end, the cage 220 terminates in a perforated skirt 219, and as shown in the drawing of FIG. 15 members 217 or bars extending longitudinally inside the bag 214 and in the axis of the latter can be seen. In the example illustrated, there are four of these bars 217. As with the devices shown in FIGS. 11 to 14, the height of the cage 220 can be variable, so that the skirt 219 can terminate near the bottom 214*b* of the bag 214 or stop at an intermediate distance inside the bag 214. The end 219 has likewise been shown in the form of a perforated skirt, but a solid disc could also be used. In the assembly illustrated in FIG. 15, the bars 217 comprise a part 217*b* substantially parallel to the axis of the bag 214 and another part 217*a* oriented obliquely so as to be connected to the rod 216. Many other alternative embodiments are possible, whilst at the same time adopting a general cage form. As an example, an alternative version has been shown in FIG. 16. The latter illustrates maintaining means in the form of cage designated by the general reference 220. At one end, there is a tubular part 216 of small dimensions, which is intended to be introduced into the central aperture 213 of the ring 211. At the other end, the cage 220 terminates in a skirt 219. Also shown are the bars 217 which comprise longitudinal parts 217*b*, other parts 217*a* being connected to the tubular part 216**.

The alternative version of FIG. 16 shows another skirt **219*a* which is mounted so as to support the bars 217*b*, before they change direction in the form of bars 217*a* in order to meet the rod 216**. The mechanical stability of the assembly is thus further improved. Such alternative versions are within the reach of an average person skilled in the art, the more so because they are easy to produce by means of the techniques of the injection-molding of plastics.

With the device of the type illustrated in FIGS. 15 and 16, good washing results are obtained, above all if the cross-section of the cage 220 is somewhat similar to that of the bag 214.

Figure 18:
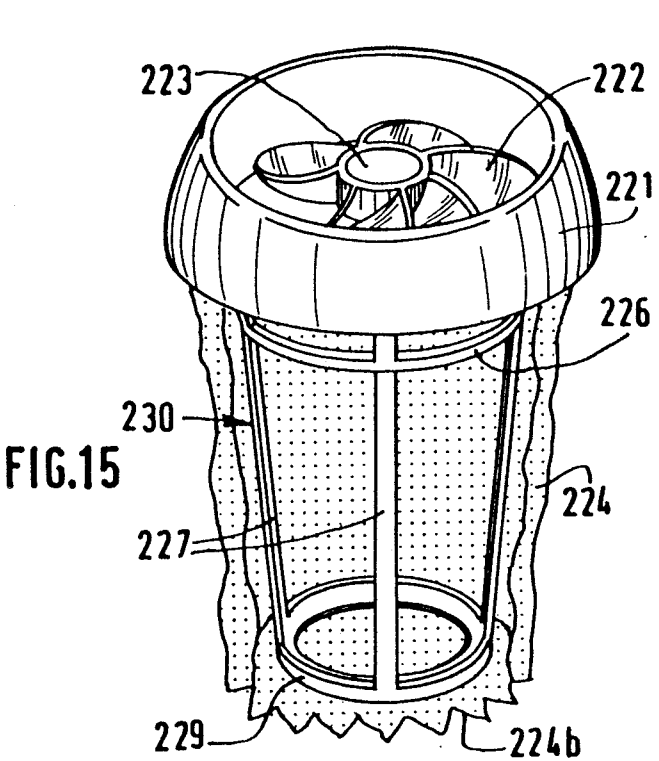
FIG. 18 is a partially cut away perspective view of the device of FIG. 17, the said device being assembled and ready to use.
Figure 17:
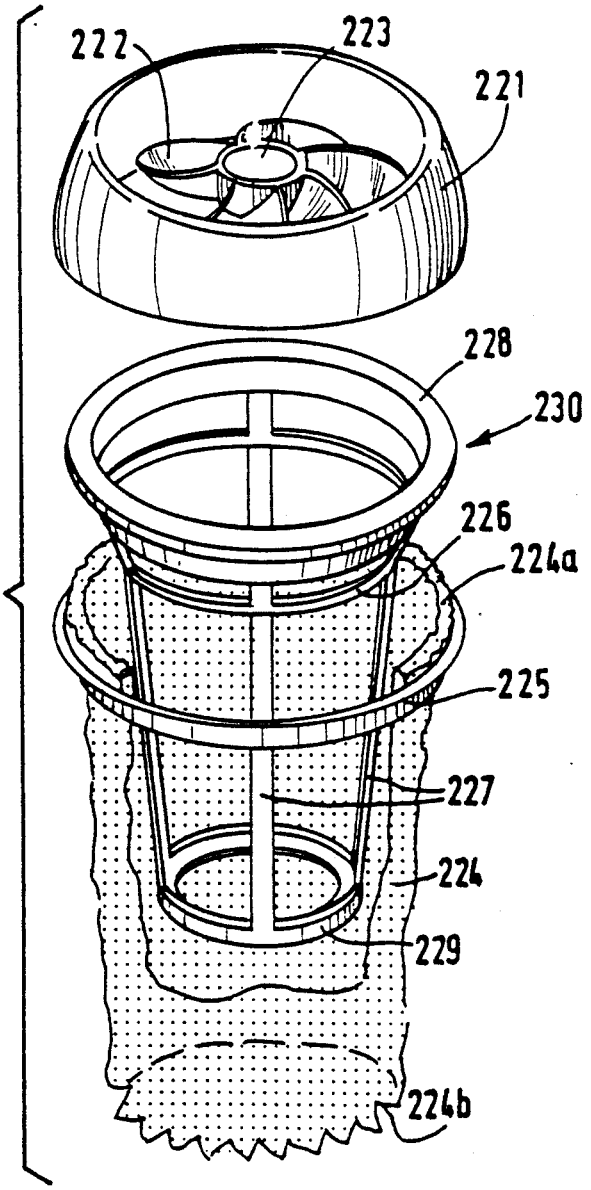
FIG. 17 is an exploded, partially cut away perspective view of another embodiment of the device of the invention.

FIGS. 17 and 18 illustrate another embodiment which has proved to give especially useful results for the machine-washing of fabrics.

The exploded view of FIG. 17 shows the various components of the device. This first of all comprises a ring 221 having helical masking means 222 extending round a hollow central shaft 223. Furthermore, the bag 224 has a bottom **224*b* and is fastened at its other end 224*a* to a collar 225 which can interact with the ring 221 by a matching of forms. The maintaining means consist of an assembly designated by the general reference 230. The latter comprises two members 226, 229 of general annular form. The collar 226 has a rim 228 capable of bearing on the collar 225 delimiting the mouth of the bag, so that, during assembly, the ring 221 caps the rim 228 and the collar 225. The assembly 230 is thus fixed both to the collar 225 carrying the bag 224 and the the ring 221** which is fastened by any suitable means: screwing, simple insertion or quick fastening by snapping (of the bead/groove type).

Between the annular members 226 and 229 extend a certain number of bars 227 which give the assembly 230 a general frustoconical form, the cross-section of the member 226 being larger than that of the member 229. Here too, the production of the assembly 230 and that of the other components of the device are within the scope of an average person skilled in the art, if he uses the conventional means for the molding of plastic.

FIG. 18 illustrates the device of FIG. 17, once assembled, that is to say in the condition for use. The partial cut away made in the bag 224 makes it possible to see, inside this, the arrangement of the assembly 230 which serves for maintaining the general form of the bag. In the example illustrated, the longitudinal dimension of the assembly 230 is such that the annular member 229 reaches a short distance from the bottom **224*b* of the bag 224. This arrangement has given the best practical results, and it was found that no residue of particulate product, such as a detergent, remained at the end of a washing operation. However, possible alternative versions can be employed with different dimensions of the assembly 230, this then extending inside the bag 224 at variable levels. It was also found that a structure of the maintaining means which is like that of the assembly 230** gave the latter an excellent mechanical stability.

The invention will be further illustrated by the following actual examples of carrying out the process of the invention. In a first series of examples, a dispensing and diffusing device comprising a flexible bag of a capacity of 250 ml to 400 ml and of the approximate form shown in FIG. 2 was used. Its mouth was delimited by a polypropylene ring, such as that illustrated above with reference to FIG. 5. In these tests reported below, the fabrics were washed with doses of detergent varying between 150 g and 250 g. In some tests, the bag was made of a cotton fabric, the mesh apertures of which were of a size below approximately 0.5 mm. Other tests were conducted with a bag made of nonwoven cotton having mesh apertures within a range of approximately 0.5 to 0.8 mm, and equivalent results were obtained.

The active product used in the tests was a detergent composition for coarse washing, as defined below:

| | |
|---|---|
| Alkyl sulphates | 7-10% |
| Fatty acid | 1-3% |
| Aluminium and sodium silicates | 15-25% |
| Water-soluble polymers | 1-3% |
| Sodium perborate | 10-25% |
| Sodium silicate | 3-8% |
| Sodium sulphate | 10-40% |
| Sodium carbonate | 5-10% |
| Alkalase | 0-2% |

All the parts given above are by weight. In some of the tests, the above composition had added to it a quantity of up to 5% of a bleaching activator, namely tetraacetylethylene diamine. In all cases, excellent results were obtained in the washing performances.

Comparative tests were carried out to assess the dissolving rate of one and the same granular detergent composition for coarse washing, of the type just described, under conditions similar to those for the machine-washing of fabrics. The device used was a dispensing device according to the present invention, comprising a ring, such as that shown in FIG. 5, and a bag consisting of a coextruded polypropylene film with mesh apertures of approximately 380 microns. Furthermore, the same tests were conducted on a dispensing device having an identical ring, but extended by a solid polyethylene body. In both cases, the capacity of the device was approximately 200 g. The results obtained showed that the dissolving rate of the composition was higher with the device according to the invention, this being proved by the measurements made on the quantity of detergent released into the bath, above all for a period of 8 to 10 minutes after the device had been placed in the machine. This is especially favorable for the washing of linen.

Additional comparative tests were undertaken in order to demonstrate the advantages afforded by a dispensing and diffusing device with a flexible bag in the machine-washing of linen. The tests reported below were conducted, on the one hand, with a device according to the invention comprising a bag of cotton fabric fastened to a ring of the type shown in FIG. 5 and, on the other hand, with a device comprising a rigid polyethylene body fixed to a ring identical to that of FIG. 5. The defined granular detergent composition for coarse washing was used in all cases.

The conditions of the tests of the machine-washing of linen were as follows:

| | |
|---|---|
| Type of washing machine: | Miele and Siemens washing machines available on the market |
| Washing temperature: | 30° C., 60° C. and 90° C. respectively |
| Washing cycle: | main wash only |
| Hardness of the water: | mean value corresponding to the town water of the main distribution system |
| Drying: | in a vibrating dryer |
| Linen load: | fabrics of ordinary household articles at 2 kg (30° C.) and 3 kg (60 and 90° C.) with, as points of comparison, four identical pairs of samples characteristic for each test, the number of comparative tests being 24. |

The washing results were evaluated by experts who thus carried out 288 visual evaluations (that is to say, 12 for each test), based especially on the characteristic samples.

The preference rate (61%), expressed in favor of the flexible-bag device of the invention, was markedly higher than that (39%) relating to the rigid device.

The above results therefore show the superiority of the performances obtained by means of the invention in the machine-washing of linen.

Other machine-washing tests were conducted with devices of the invention, such as those illustrated in the abovementioned FIGS. 11 to 18, each time the bag being made of unwoven cotton. The particular product used was a detergent powder conforming to the following approximate composition:

| | |
|---|---|
| Straight-chain alkylbenzene sulphonate | 5.64 |
| Alkyl sulphate (tallow) | 2.42 |
| Non-ionic | 5.76 |
| Sodium tripolyphosphate | 24.00 |
| Zeolite A | 5.39 |
| Polymers | 3.60 |
| Sodium perborate | 13.50 |
| Tetraaminoethylenediamine | 5.28 |
| Enzyme | 1.62 |
| Buffer | 21.18 |
| Chelating agents | 1.08 |
| Miscellaneous and moisture | add 100 |

The above composition, in which the parts expressed by weight, corresponds to a detergent which, as additive, contains a constituent with a phosphate base, namely sodium tripolyphosphate.

Other detergent compositions in powder form were also used, particularly compositions without phosphate, such as that given below:

| | |
|---|---|
| Straight-chain alkylbenzene sulphonate | 6.63 |
| Alkyl sulphate (tallow) | 2.43 |
| Non-ionic | 6.11 |
| Zeolite A | 22 |
| Polymers | 5.60 |
| Sodium perborate | 16 |
| Tetraaminoethylenediamine | 5.76 |
| Enzyme | 1.62 |
| Buffer | 20 |
| Chelating agents | 0.80 |
| Miscellaneous and moisture | add 100 |

The quantity of product used was 260 g in each case. The washing tests were conducted by placing white and colored napkins in the drum of the machine, and for the requirements of the demonstration the device was placed in the middle of the napkins to be washed, these being folded in order to cover the device thus put in place.

The washing machine was subsequently started up (programme 7°-40° C.) and the complete washing cycle was allowed to come to an end. The device was then recovered, care being taken to grasp it by its mouth ring, in order to take careful look at any residues of undissolved powder which could have remained inside the bag, especially at the bottom of this.

As a comparison, devices having no maintaining means inside the bag were also used. In all cases, the devices with maintaining means proved superior, in that the quantities of undissolved powder residue either were completely absent or, at all events, were markedly lower than those of the device not having any maintaining means. The best results were recorded with devices of the type illustrated in FIGS. 17 and 18. I was also found that, even after numerous washes (10 to 20 washes), the device could be reused without any wear of the bag.

The present invention has been illustrated by means of devices having a mouth with masking means. There is no doubt that the same arrangements could also be adopted with devices without a masking means, that is to say with a completely free mouth of the bag. Likewise, the practical tests were conducted with bags of which the component material was permeable to the aqueous medium. It goes without saying that the invention can also be used with devices of which the bag is impermeable to the aqueous washing medium.

It will also be noted that a certain quantity of particulate material can pass through the mouth of the device in the undissolved state, above all at the start of the washing cycle. The advantages of a progressive dissolving of the material contained in the bag and of its diffusion into the linen are nonetheless achieve during the washing operation.

As an average person skilled in the art will easily understand, many modifications can be made to the present invention, without thereby departing from its scope. Thus, in the preceding examples, the invention was illustrated, above all, in terms of its use with particulate detergents, but it must be obvious that the invention can also be used with other particulate active products useful in the washing, which can be present separately and exert their specific effects at selected moments in the washing cycle, either the start of this or during the washing.

We claim:

1. A metering and diffusing device for a particular product for use in a washing machine, said device comprising a flexible sheath in the form of a bag made of material permeable to an aqueous medium, said bag being attached to and extending from a support ring defining an orifice, said orifice being adapted to admit to the bag the quantity of particular product required for one washing cycle of the washing machine and to remain at least partially open during said washing cycle whereby a portion of aqueous washing medium in the machine flows through said orifice and said sheath to the interior of the bag to contact and dissolve said particulate product and the solution thereby formed passes outwardly through the orifice and the sheath into the aqueous washing medium, said support ring having masking means spanning the orifice and adapted to substantially prevent the release of wetted undissolved particulate product therethrough.

2. The metering and diffusing device of claim 1 in which a form maintaining means depends from the support ring into the bag to prevent collapse of the bag.

3. The metering and diffusing device of claim 2 in which the proximal end of the form maintaining means comprises a rod attached to the support ring.

4. The metering and diffusing device of claim 3 in which the distal end of the form maintaining means is radially enlarged.

5. The metering and diffusing device of any of claims 2, 3 or 4 in which the sides and bottom of the form maintaining means are adjacent the sides and bottom of the bag interior.

6. The metering and diffusing device of claim 5 in which the form maintaining means is constructed as a cage-like structure generally similar in exterior shape to the interior of the bag.

7. The metering and diffusing device of claim 5 in which the support ring is constructed of thermoplastic material and said masking means is formed integrally with the ring.

8. The metering and diffusing device of claim 7 in which the masking means has a hub-like center and radially extending walls connecting the center to the peripheral element defining said ring.

9. The process for machine-washing of fabrics using a dispensing and diffusing device comprising a flexible bag-shaped sleeve made of material permeable to an aqueous medium, said sleeve being attached to a support ring defining an orifice, said process comprising placing a quantity of particulate washing agent corresponding to that required for one washing cycle into the sleeve through the orifice, placing the device into said machine along with the fabrics to be washed and wash water, allowing water to enter the device through the orifice and the sleeve and to progressively dissolve the washing agent, and obstructing the release of wetted particulate washing agent through the orifice while permitting the agent in solution to pass therethrough and through the sleeve during the wash cycle, whereby waste of washing agent is prevented.

* * * * *

UNITED STATES PATENT AND TRADEMARK OFFICE

CERTIFICATE OF CORRECTION

PATENT NO. : 4,969,927

DATED : Nov. 13, 1990

INVENTOR(S) : K.M. Schumann, B.E. Talkes, C.J. Lowery, J.R. Lickiss, M. Curtis, H.G.W. Dickenson It is certified that error appears in the above-identified patent and that said Letters Patent is hereby corrected as shown below:

On the title page, FOREIGN PATENT DOCUMENTS, add the following reference -- 1,298,454 12/1972 Great Britain -- .

In the ABSTRACT, line 10, "A" should read -- An -- .

Column 2, line 9, "in" should read -- an -- .

Column 7, line 11, after "predetermined" insert -- apertures. Very many embodiments are possible, provided that the -- .

Column 10, line 28, "is" should read -- it -- .

Column 11, line 33, "questions in" should read -- question is -- .

Column 12, line 68, "later" should read -- latter -- .

Column 15, line 35, "he" should read -- the -- .

Column 19, line 10, "I" should read -- It -- .

Column 19, line 29, "achieve" should read -- achieved -- .

Column 19, line 43, "particular" should read -- particulate -- .

Column 19, line 49, "particular" should read -- particulate -- .

Signed and Sealed this

Second Day of March, 1993

*Attest:*

STEPHEN G. KUNIN

*Attesting Officer*

*Acting Commissioner of Patents and Trademarks*